US011470909B2

(12) United States Patent
Su et al.

(10) Patent No.: US 11,470,909 B2
(45) **Date of Patent: *Oct. 18, 2022**

(54) SHOE COVER

(71) Applicant: Suzhou Addison Nonwoven Product Co., Ltd., Jiangsu (CN)

(72) Inventors: Jau-Ming Su, Suzhou (CN); Huan Wang, Suzhou (CN); Xiurong He, Suzhou (CN)

(73) Assignee: SUZHOU ADDISON NONWOVEN PRODUCT CO., LTD., Jiangsu (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/398,039

(22) Filed: Aug. 10, 2021

(65) Prior Publication Data

US 2021/0361023 A1 Nov. 25, 2021

Related U.S. Application Data

(63) Continuation-in-part of application No. 15/771,065, filed as application No. PCT/CN2016/103298 on Oct. 25, 2016, now Pat. No. 11,116,276.

(30) Foreign Application Priority Data

Oct. 26, 2015 (CN) ..... 201520832885.1

(51) Int. Cl.
*A43B 3/16* (2022.01)
*A43B 13/22* (2006.01)
(Continued)

(52) U.S. Cl.
CPC ..... *A43B 3/16* (2013.01); *A43B 13/122* (2013.01); *A43B 13/22* (2013.01); *A43B 23/026* (2013.01)

(58) Field of Classification Search
CPC .. A43B 3/15; A43B 3/248; A43B 5/18; A43B 13/22; A43C 11/004
(Continued)

(56) References Cited

U.S. PATENT DOCUMENTS 3,851,411 A * 12/1974 Crosbie ..... C08L 2666/04 36/68
4,616,429 A 10/1986 Alcala
(Continued)

FOREIGN PATENT DOCUMENTS

CN 2262352 9/1997
CN 2666219 12/2004
(Continued)

OTHER PUBLICATIONS

International Search Report for PCT/CN2016/103298, dated Dec. 15, 2016.
(Continued)

*Primary Examiner* — Sharon M Prange
(74) *Attorney, Agent, or Firm* — Schmeiser, Olsen & Watts, LLP

(57) ABSTRACT

A shoe cover comprises a shoe cover upper comprised of non-woven fabric; a shoe cover opening formed in the shoe cover upper; a shoe cover sole integrated with the shoe cover upper; a first sealing part extending from the top edge to the bottom surface of the shoe cover sole towards the front end of the shoe cover upper; a second sealing part extending from the top edge to the bottom surface of the shoe cover sole towards a rear end of the shoe cover upper; an elastic ring provided within a first accommodating space of the shoe cover upper proximate the shoe cover opening; an elastic strip provided on the shoe cover sole and extending along a front-rear direction; and a plurality of anti-slip strips disposed on the outer bottom surface of the shoe cover sole
(Continued)

and comprised of an isotactic polypropylene polymer and/or an isotactic polypropylene derivative.

16 Claims, 12 Drawing Sheets

(51) Int. Cl.
*A43B 13/12* (2006.01)
*A43B 23/02* (2006.01)

(58) Field of Classification Search
USPC ..... 36/7.1 R, 7.2, 7.3, 8.3, 10
See application file for complete search history.

(56) References Cited

U.S. PATENT DOCUMENTS

| | | | | | |
|---|---|---|---|---|---|
| 5,112,421 | A | | 5/1992 | Honda | |
| 5,150,536 | A | | 9/1992 | Strong | |
| 5,251,386 | A | | 10/1993 | Diaz | |
| 5,822,884 | A | * | 10/1998 | Roeder | A43B 3/163 36/7.1 R |
| 6,023,856 | A | * | 2/2000 | Brunson | A43B 3/163 36/7.1 R |
| 6,209,227 | B1 | * | 4/2001 | Swango | A43B 3/16 36/7.1 R |
| 6,833,171 | B2 | * | 12/2004 | Campbell | A43B 3/16 36/4 |
| 9,635,900 | B1 | | 5/2017 | Rolle | |
| 2003/0119410 | A1 | | 6/2003 | Bodaghi | |
| 2003/0190442 | A1 | | 10/2003 | Campbell | |
| 2008/0014819 | A1 | | 1/2008 | Suzuki | |
| 2009/0105397 | A1 | | 4/2009 | Van Riel | |
| 2010/0292403 | A1 | | 11/2010 | Ansems | |
| 2013/0042501 | A1 | | 2/2013 | Velazquez | |
| 2013/0074363 | A1 | | 3/2013 | Adams | |
| 2016/0095377 | A1 | | 4/2016 | Tamm | |
| 2017/0074829 | A1 | | 3/2017 | Mertins | |
| 2017/0181498 | A1 | | 6/2017 | Whelan | |

FOREIGN PATENT DOCUMENTS

| | | | |
|---|---|---|---|
| CN | 202197918 | | 4/2012 |
| CN | 103478979 | | 1/2014 |
| CN | 103478979 | A * | 1/2014 |
| CN | 104844939 | | 8/2015 |
| CN | 205053010 | | 3/2016 |

OTHER PUBLICATIONS

Written Opinion for PCT/CN2016/103298, dated Dec. 15, 2016.
Restriction Requirement dated Aug. 8, 2019 for U.S. Appl. No. 15/771,065.
Non-Final Office Action dated Oct. 29, 2019 for U.S. Appl. No. 15/771,065.
Final Office Action dated May 27, 2020 for U.S. Appl. No. 15/771,065.
Advisory Action dated Aug. 11, 2020 for U.S. Appl. No. 15/771,065.
Non-Final Office Action dated Nov. 6, 2020 for U.S. Appl. No. 15/771,065.
Notice of Allowance dated May 12, 2021 for U.S. Appl. No. 15/771,065.

* cited by examiner

SHOE COVER

CROSS REFERENCE TO RELATED APPLICATIONS

This application is a continuation-in-part patent application of U.S. application Ser. No. 15/771,065 filed on Apr. 25, 2018, which claims priority to PCT Application No. PCT/CN2016/103298, having a filing date of Oct. 25, 2016, which is based upon and claims priority to CN Application No. 201520832885.1, having a filing date of Oct. 26, 2015, the entire contents of all priority documents which are incorporated herein by reference.

FIELD OF TECHNOLOGY

The following belongs to the field of personal protective articles, and in particular to a shoe cover.

BACKGROUND

Shoe covers are widely used in hospital clinics, home life, agriculture and aquaculture, outdoor activities and other fields, so there is a greater market demand; according to the material and use of the shoe covers, they can be divided into non-woven shoe cover, CPE shoe cover, cloth shoe cover, anti-static shoe cover, flannel shoe cover, rain shoe cover, anti-slip shoe cover and so on. At present, shoe covers on the market are basically manually sewn, which require to go through the processes such as cutting, sewing, sorting and packaging, expends a lot of manpower cost and have low production efficiency. Of course, a small part of the shoe covers are made by automation equipment, and the cost of the shoe covers produced thereby is greatly reduced, however, there are many defects in the shoe covers: the shoe cover could not tighten a foot and is easy to fall off; the opening of the toe is easily torn; and the fabrics of the toe and the heel are redundant and are easy to be stepped on and lead to tumbling.

SUMMARY

An aspect relates to overcoming the shortcomings of the conventional art and providing a shoe cover.

To achieve the above purpose, the technical solution employed by the present application is:

a shoe cover comprising:

a shoe cover upper provided with a shoe cover opening at the top thereof; the shoe cover opening is provided with a first elastic ring;

a shoe cover sole connected with the bottom of the shoe cover upper; a second elastic ring is provided on the shoe cover upper near the shoe cover sole.

Optimally, the shoe cover opening has a front sealing part and a rear sealing part corresponding to the shoe cover upper, and the front sealing part and the rear sealing part have reinforced structures.

Optimally, a plurality of anti-slip strips are provided at the bottom of the shoe cover sole.

Optimally, it is formed by sealing after folding fabric in half.

Optimally, at least the front portion of the shoe cover upper is curve-shaped, and the front portion and rear portion of the shoe cover sole are also curve-shaped.

Optimally, the distance between the second elastic ring and the bottom of the shoe cover sole is 5-25 mm.

Optimally, the shoe cover is fabricated by automation equipment.

Further, the reinforced structure is a sewing thread added in the front or rear of the front sealing part or the rear sealing part, a cladding fabric strip folded in half and sealed therewith; or, sealing area added for it.

Further, the anti-slip strips are in the shape of strips, circles, dots, S-shapes or other shapes, and are made of non-stick high-friction polymeric material.

Further, the shoe cover fabric is formed by bonding non-stick high-friction polymeric material and non-woven fabric, or is made of one of non-woven fabric or plastic film.

Further, the shoe cover fabric (9) is made of non-woven fabric composite, non-woven fabric or plastic film; the non-woven fabric composite is formed by bonding non-stick high-friction polymeric material and non-woven fabric.

The non-stick high-friction polymeric material contains an isotactic polypropylene polymer and/or an isotactic polypropylene derivative, and the flow rate parameter of the isotactic polypropylene polymer and/or the isotactic polypropylene derivative is 5-15, preferably 5.5-8; the flow rate parameter is calculated as $(MI_{5\ KG}-MI_{2.16\ KG})/(5-2.16)$, where $MI_{5\ kg}$ and $MI_{2.16\ kg}$ are melt indexes respectively measured according to ASTM Standard D1238 (Standard Test Method for Melt Flow Rates of Thermoplastics) at 190° C. and at a test loads of 5 kg and 2.16 kg, respectively, namely the ratios of the melt index increment to the load increment for the two loads, which represents the sensitivity of the material to shear forces.

Further, the non-stick high-friction polymeric material contains an isotactic polypropylene structure and/or an isotactic polypropylene derivative structure (the polypropylene derivative structure here refers to a polypropylene structure which is grafted or segmented with usual groups such as ethyl, butyl, hexyl, octyl, etc.), which specifically refers to the structure of the general formula of it or components thereof contains a block of an isotactic polypropylene structure and/or an isotactic polypropylene derivative structure, and a block of such chemical structures may be arranged irregularly or regularly; and the flow rate parameter of the isotactic polypropylene structure and/or the isotactic polypropylene derivative structure is 5-15.

Further, the isotactic polypropylene polymer and/or the isotactic polypropylene derivative contains isotactic co-polypropylene elastomer containing 5-30% by mass of ethylene structures and/or isotactic homo-polypropylene having a melt index of 1-15 g/10 min, namely the melt index measured according to ASTM Standard D1238 at 190° C. and at a test load of 2.16 kg is 1-15 g/10 min.

Further, the raw material formula of the non-stick high-friction polymeric material contains the following components in percentage by mass:

20-90% of isotactic co-polypropylene elastomer; 10-80% of isotactic homo-polypropylene.

In an embodiment, it may further contain a slip agent; 0-10% of an anti-block agent; 0-10% of an antistatic agent; 0-10% of a color masterbatch; 0-10% of a flame retardant; 0-10% of an antibacterial agent; 0-10% of a filling agent. Specifically, it may be added according to practical requirements, and it should be noted that some unexpected effects may be obtained when a variety of additives (for example, slip agents, antistatic agents, antibacterial agents and flame retardants) are used in combination: improving the toughness and the adhesion property with other substances of the polymeric material. Or, the blending ratio is 10-99.5% of isotactic co-polypropylene elastomer, 0-90% of polyethylene, 0-10%, preferably 0.5-10% of each of a slip agent, an anti-block agent, an antistatic agent, a color masterbatch, a flame retardant, an antibacterial agent, a filling agent.

The polymeric material employed in the above proportions, is made to be a film through melt-mixing, and film blowing or film casting; or is made to be a non-woven fabric composite through on-line thermal bonding with polypropylene non-woven fabric, cooling and curing, where the polypropylene non-woven fabric may be selected from corona-treated non-woven fabric to improve the adhesion. The film maybe a monolayer film, or a coextruded or composite multilayer film of double layers or more, and maybe single-sided or double-sided non-slip. The on-line bonding method includes on-line film casting, on-line coating and the like; the non-woven fabric composite may be single-sided or double-sided fully bonded, locally partially bonded, partially bonded in strip, dot, circle or other shape.

Due to the present application contains the isotactic polypropylene structure and/or the isotactic polypropylene derivative structure, it has excellent mechanical properties; at the same time, the material with a specific flow rate parameter and melt index produces unexpected effects: the material obtained has high slip resistance and no stickness. And, the non-woven composite has a polymeric material containing an isotactic polypropylene structure or/and an isotactic polypropylene derivative structure on one side and polypropylene on the other side, and with the same family of polymeric material, the two surface layers on both sides form a homogeneous single-phase structure through mutually diffusing, mutually penetrating and mutually entangling of molecules after heating and melting, which has a strong bonding strength after curing, without using adhesive. COF (coefficient of friction) thereof can be up to 0.3-1.8.

Further, the raw material formula of the non-stick high-friction polymeric material contains the following components in percentage by mass:

isotactic co-polypropylene elastomer 10-99.5%; polyethylene 0-90%. In an embodiment, it may further contain 0-10% of a slip agent; 0-10% of an anti-block agent; 0-10% of an antistatic agent; 0-10% of a color masterbatch; 0-10% of a flame retardant; 0-10% of an antibacterial agent; 0-10% of a filling agent.

Further, the melt index of the isotactic polypropylene polymer and/or the isotactic polypropylene derivatives is 0.5-20 g/min; or, the density of the isotactic polypropylene polymer and/or the isotactic polypropylene derivative is 0.7-1.1 g/cm$^3$.Due to the applying of the above technical solutions, the present application has the following advantages over the conventional art: The shoe cover of the present application, through providing the second elastic ring at where the shoe cover upper joins the shoe cover sole, may utilize the second elastic ring to strap the shoe cover upper and the shoe cover sole onto either a foot or a shoe, which can prevent the shoe cover from falling off, and furthermore facilitates the shoe cover upper and the shoe cover sole in affixing onto the foot or shoe.

Another technical solution employed by the present application is: a shoe cover comprising:

a shoe cover upper comprised of non-woven fabric, the shoe cover upper having a front end and a rear end;

a shoe cover opening formed in the shoe cover upper, the shoe cover opening defined by a top edge of the shoe cover upper;

a shoe cover sole integrated with the shoe cover upper, the shoe cover sole having a bottom surface;

a first sealing part extending from the top edge to the bottom surface of the shoe cover sole towards the front end of the shoe cover upper, the first sealing part having a first reinforced structure including a blocky fabric folded in half and sealed therewith, wherein the first reinforced structure is discretely located at a single location along the first sealing part, proximate the top edge of the shoe cover upper;

a second sealing part extending from the top edge to the bottom surface of the shoe cover sole towards a rear end of the shoe cover upper;

an elastic ring provided within a first accommodating space of the shoe cover upper proximate the shoe cover opening, below the top edge of the shoe cover upper;

an elastic strip provided on the shoe cover sole and extending along a front-rear direction; and a plurality of anti-slip strips disposed on the outer bottom surface of the shoe cover sole, the plurality of anti-slip strips comprised of an isotactic polypropylene polymer and/or an isotactic polypropylene derivative;

wherein a portion of the front sealing part and a portion of the rear sealing part extends between the plurality of anti-slip strips disposed on the outer bottom surface of the shoe cover sole.

When in use, the elastic strip can tighten the bottom of the shoe cover in front-rear direction. In some embodiments, the elastic strip extends from the first sealing part to the second sealing part.

In some embodiments, the elastic strip is spaced apart from the first sealing part to the second sealing part.

In some embodiments, the anti-slip strips extend along the front-rear direction, and the elastic strip is located between the anti-slip strips.

In some embodiments, the elastic strip is located in an inner circle enclosure by the anti-skid strips.

In some embodiments, the second sealing part has a second reinforced structure including a blocky fabric folded in half and sealed therewith, wherein the second reinforced structure is discretely located at a single location along the second sealing part, proximate the top edge of the shoe cover upper.

In some embodiments, the first and second reinforced structures have different colors, shapes or sizes. Such that, user can easily distinguish front and rear sides of the shoe cover when wearing it.

In some embodiments, the elastic strip is connected to an inner surface of the shoe cover sole.

In some embodiments, the elastic strip is connected between the inner surface of the shoe cover sole and a fabric strip.

In some embodiments, the elastic strip is connected to an outer surface of the shoe cover sole.

In some embodiments, the elastic strip is connected between the outer surface of the shoe cover sole and a fabric strip.

In some embodiments, a flow rate parameter of the isotactic polypropylene polymer and/or the isotactic polypropylene derivative is 5.5-8.

In some embodiments, a raw material formula of the isotactic polypropylene polymer and/or the isotactic polypropylene derivative contains the following components in percentage by mass:

isotactic co-polypropylene elastomer 20-90%;

isotactic homo-polypropylene 10-80%.

In some embodiments, a raw material formula of the isotactic polypropylene polymer and/or the isotactic polypropylene derivative contains the following components in percentage by mass:

isotactic co-polypropylene elastomer 10-99.5%;

polyethylene 0-90%.

In some embodiments, the isotactic polypropylene polymer and/or the isotactic polypropylene derivative contains an isotactic co-polypropylene elastomer containing 5-30% by mass of an ethylene structure, and/or an isotactic homopolypropylene having a melt index of 1-15 g/10 min under conditions of ASTM D1238, 190° C. and 2.16 KG.

In some embodiments, the anti-slip strips are in a shape of at least one of: strips, circles, dots, and S-shapes.

In some embodiments, the shoe cover is formed by sealing after folding the non-woven fabric in half.

In some embodiments, the elastic strip is connected to the shoe cover sole by ultrasonic welding, sewing, glue bonding, heat sealing or high frequency sealing; and/or, the elastic strip is covered by a fabric strip or not.

In some embodiments, the front end and the rear end of the shoe cover upper is curve-shaped.

In some embodiments, a portion of the non-woven fabric is infolded at the top edge of the shoe cover upper to form the first accommodating space which is a first channel that extends around the shoe cover upper proximate the shoe cover opening

BRIEF DESCRIPTION

Some of the embodiments will be described in detail, with references to the following Figures, wherein like designations denote like members, wherein.

DETAILED DESCRIPTION

The preferable embodiments of the present application are described herein after in detail combining with the accompanying drawings.

In the following definitions, the directions are defined in accordance with the directions observed by the user when the shoe cover covered on a foot.

Figure 25:
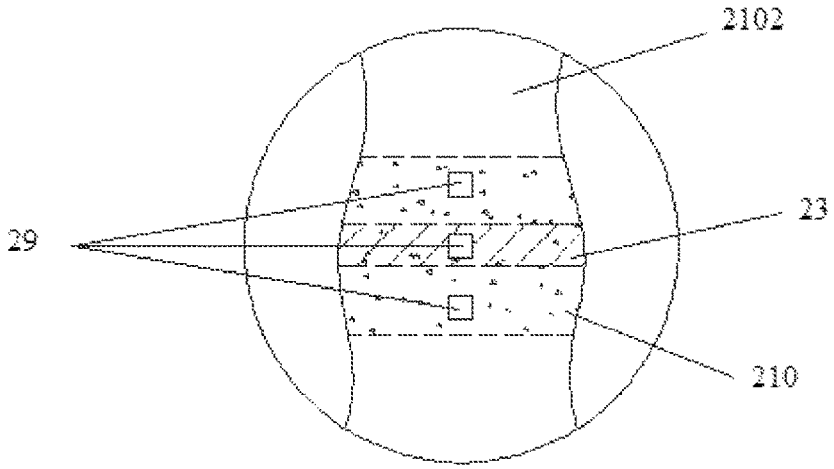
FIG. 25 shows an enlarged view of the position D in FIG. 24.
Figure 26:
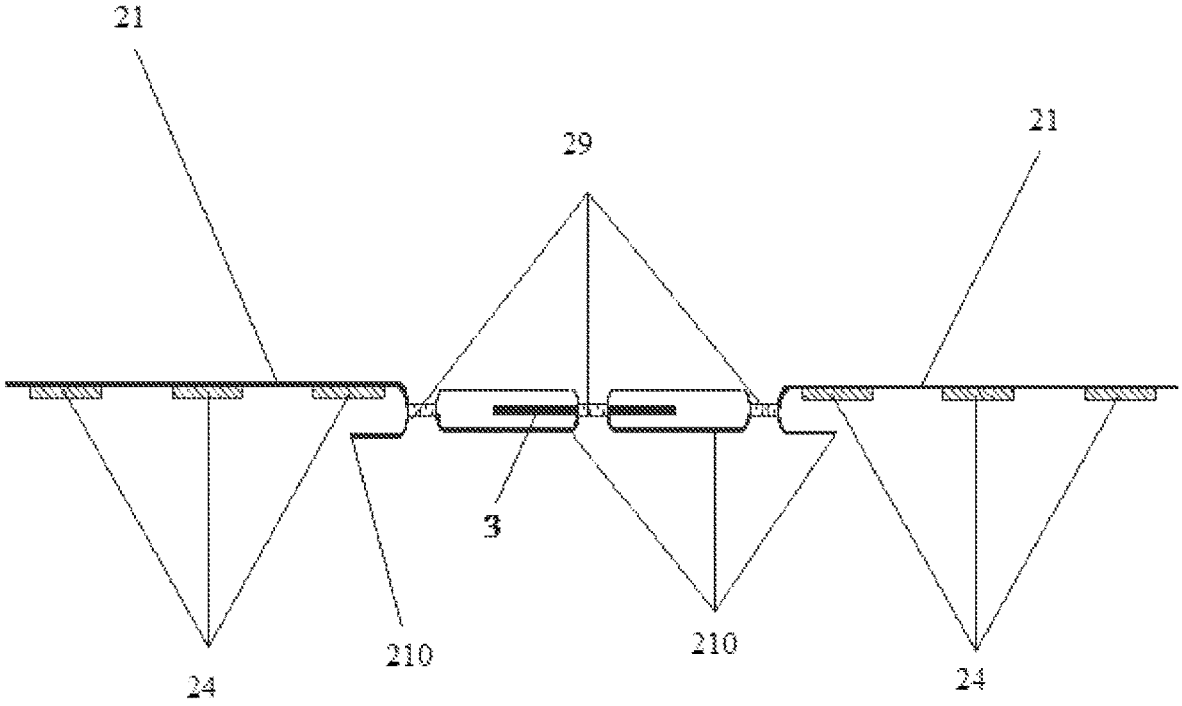
FIG. 26 shows a section view of part of the shoe cover sole of another embodiment.
Figure 27:
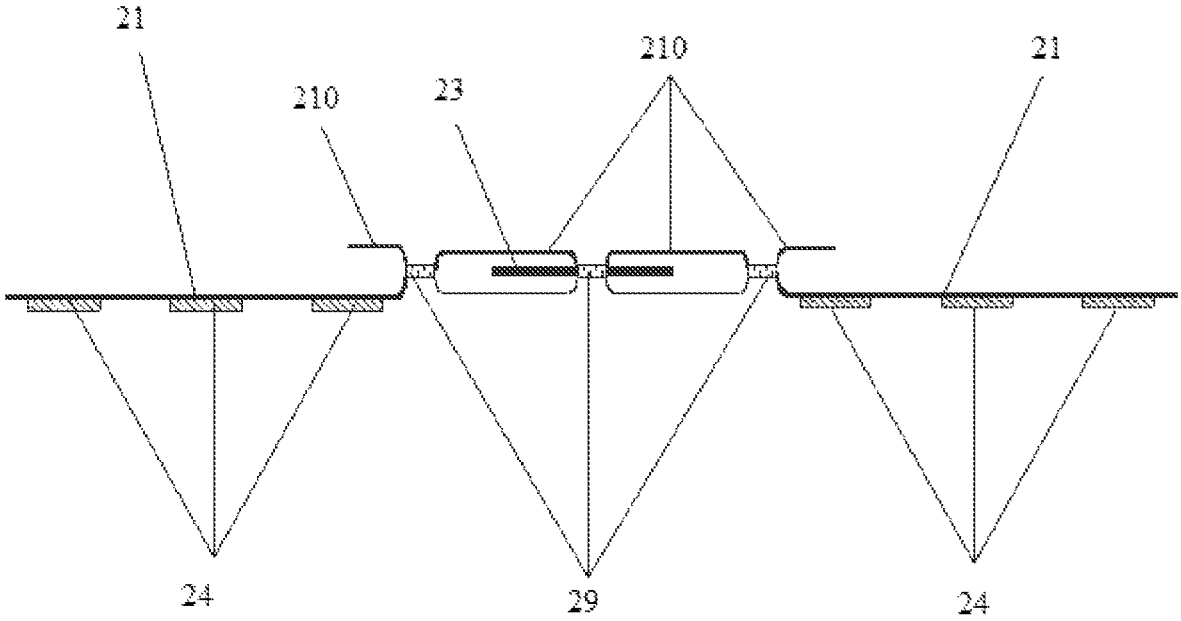
FIG. 27 shows a section view of part of the shoe cover sole of yet another embodiment.

FIGS. 1-6 show an embodiment of a shoe cover according to the present disclosure, FIGS. 18-26 show another embodiment of a shoe cover according to the present disclosure, and FIG. 27 shows yet another embodiment of a shoe cover according to the present disclosure.

Figure 1:
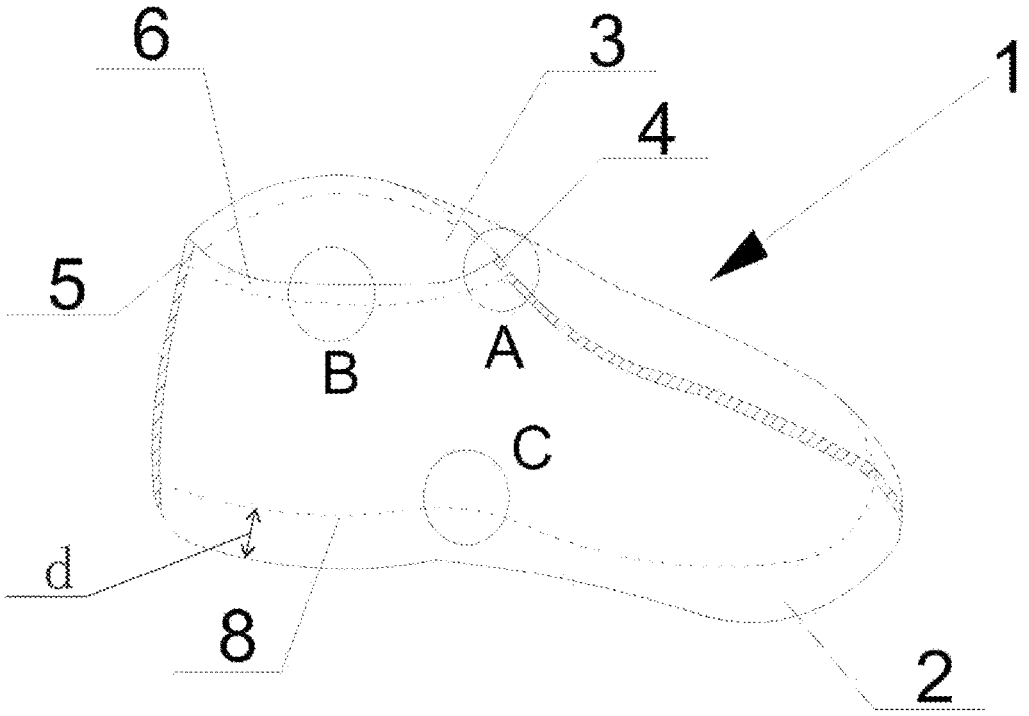
FIG. 1 shows a use state diagram of a shoe cover of one embodiment.
Figure 2:
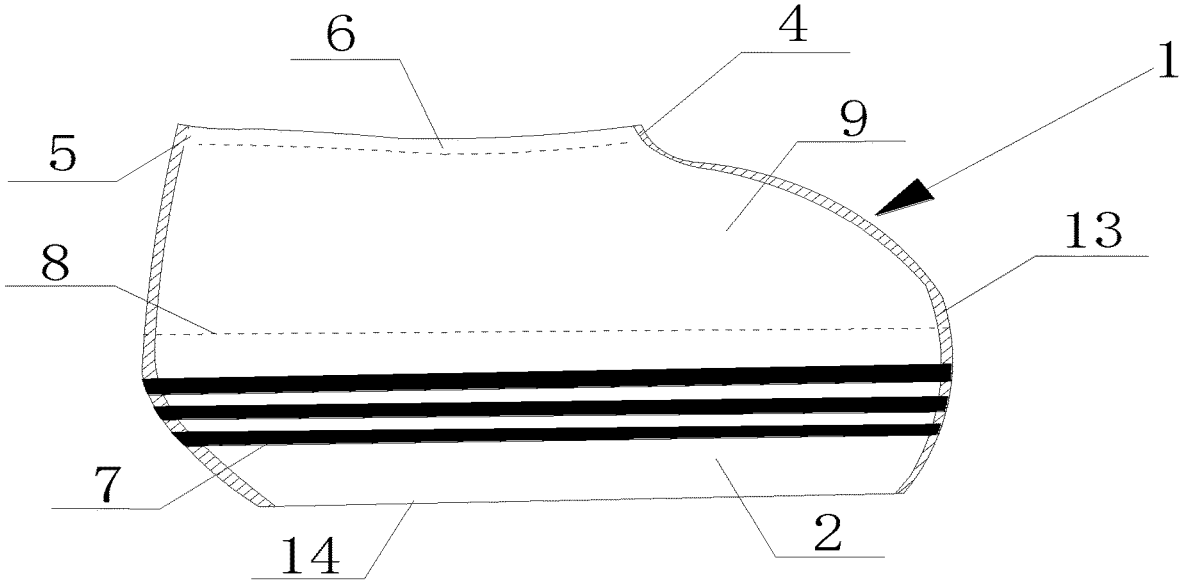
FIG. 2 shows a schematic diagram of the shoe cover in a folded and tightened state of one embodiment.

The shoe cover as shown in FIGS. 1 and 2, mainly comprises a shoe cover upper 1 and a shoe cover sole 2.

Figure 5:
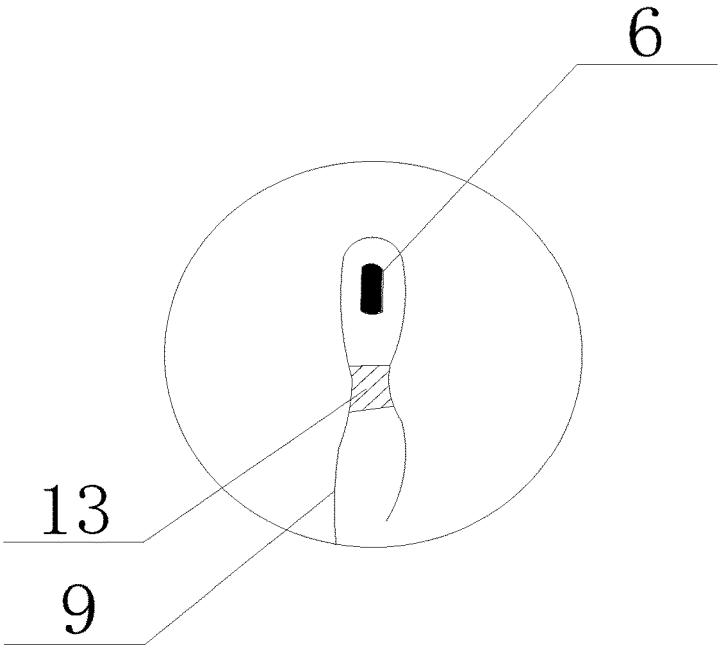
FIG. 5 shows a cross-sectional view of the first elastic ring B of the shoe cover of one embodiment.
Figure 6:
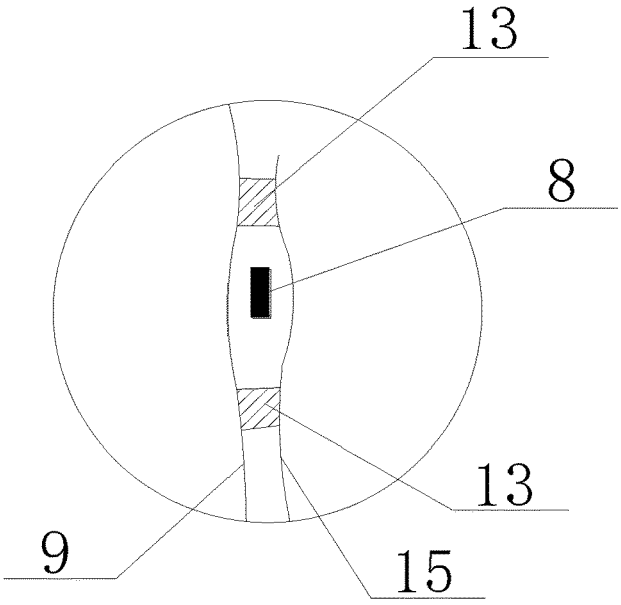
FIG. 6 shows a cross-sectional view of the first elastic ring C of the shoe cover of one embodiment.
Figure 18:
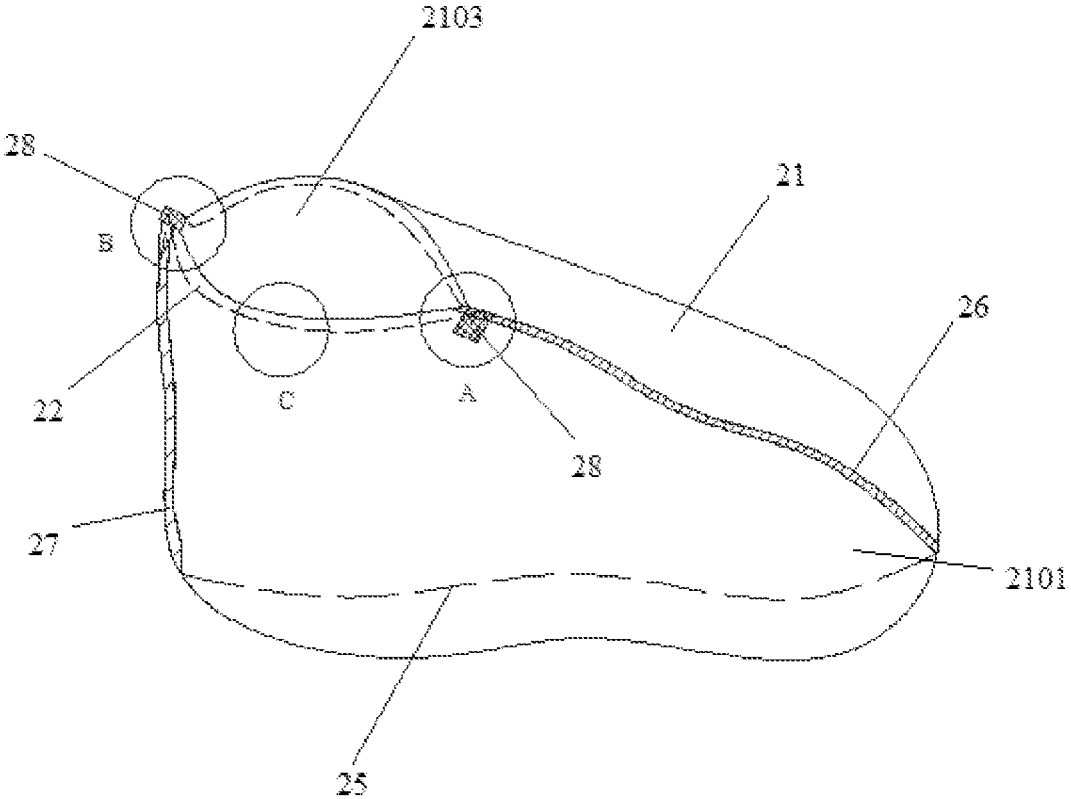
FIG. 18 shows a use state diagram of a shoe cover of another embodiment.

Wherein, a shoe cover opening 3 is provided at the top of the shoe cover upper 1, such that the shoe cover opening 3 may strap the entire shoe cover onto either a shoe or a foot. The shoe cover opening 3 is provided with a first elastic ring 6 to function as contraction and prevent the shoe cover from falling off; the edge of fabric 9 is infolded for 5-20 mm when sealing (as shown in FIG. 5) by using ultrasonic wave (or other ways), such that an accommodating space for placing the first elastic ring 6 can be formed at the shoe cover opening 3. The shoe cover sole 2 is connected with the bottom of the shoe cover upper 1, and a second elastic ring 8 is provided on the shoe cover upper 1 near the shoe cover sole 2. As shown in FIG. 6, an accommodating space is formed by sealing a strip-shaped fabric 15 with the fabric 9 by using ultrasonic wave (or other ways) to place the second elastic ring 8, such that the second elastic ring 8 is located between a lower portion of the shoe cover upper 1 and an upper portion of the shoe cover sole 2, which can utilize the second elastic ring 8 to strap the shoe cover upper 1 and the shoe cover sole 2 onto either a foot or a shoe, which can prevent the shoe cover from falling off on one hand, and facilitates the shoe cover upper and the shoe cover sole in affixing onto the foot or shoe on the other hand. As shown in FIG. 1, the distance d between the second elastic ring and the bottom of the shoe cover sole is 5-25 mm. In this embodiment, as shown in FIG. 2, the shoe cover 1 and the shoe cover sole 2 may be integrated, that is, they are made of the same piece of fabric 9 (which is formed by bonding non-stick high-friction polymeric material and non-woven fabric, or is made of non-woven fabric or plastic film, specifically referring to Chinese invention patent No. 201510305749.1) by folding in half and sealing both sides, and a folding line 14 as shown in FIG. 2 or a folding line 25 as shown in FIG. 18 is the midline, which may simplify the manufacturing flow of shoe covers, and greatly improve the level of automated production of shoe covers, such that automation equipment is used for producing and processing, improving production efficiency. The sealing line 13 may be a straight line or a curve for the purpose of making the shoe cover more fitting and avoiding to be stepped on and lead to tumbling, and at least the front portion of the shoe cover upper 1 and the front portion and rear portion of the shoe cover sole 2 are curve-shaped (of course, the rear portion of the shoe cover upper 1 may also be curve-shaped), such that the redundant fabrics on the shoe cover upper 1 and the shoe cover sole 2 are removed.

Figure 4:
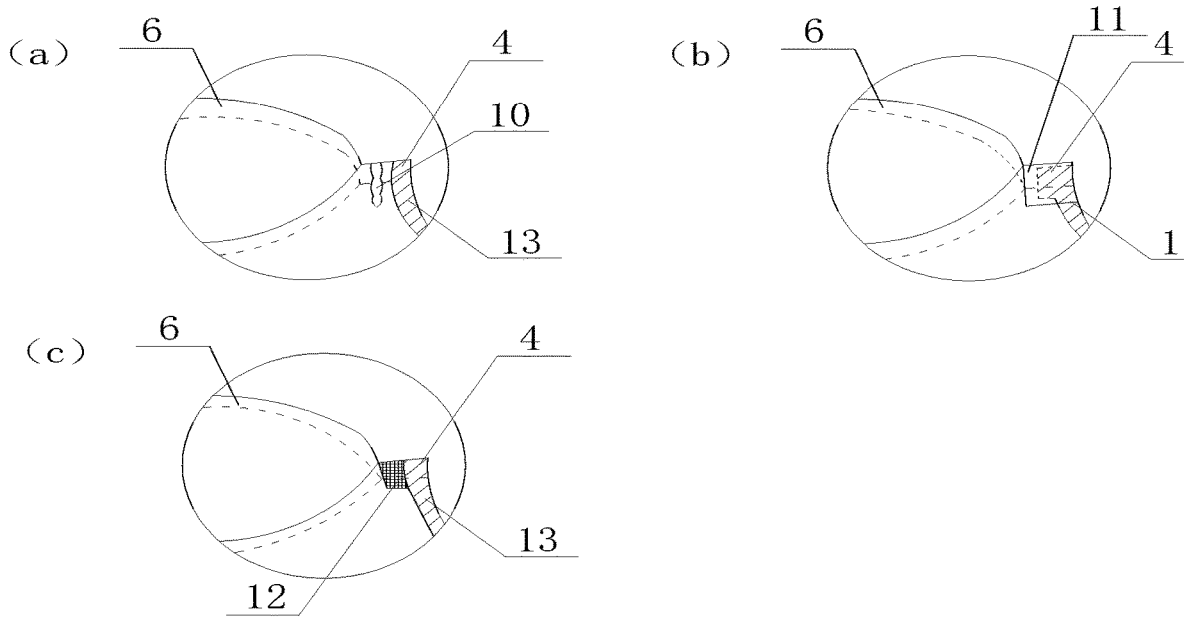
FIG. 4 shows an enlarged view of the sealing position A of the shoe cover opening of one embodiment.

The shoe cover formed after sealing forms a front sealing part 4 and a rear sealing part 5 where corresponds to the shoe cover opening 3, and a reinforced design may be provided in order to enhance the sealing strength at the front sealing part 4 and the rear sealing part 5 on the shoe cover opening 3 such that it has a corresponding reinforced structure, avoiding the opening is torn due to poor opening firmness during wearing. As shown in FIG. 4, there are a various kinds of reinforced designs: (1) adding a sewing thread 10 in front of (or in rear of, determined specifically according actual requirements) the front sealing part 4 as shown in FIG. 4(*a*); (2) employing blocky fabric 11 having the same material to the shoe cover, which is folded in half and cladded together to be sealed, as shown in FIG. 4(*b*); (3) adding sealing area 12 on the raw fabric 9, as shown in FIG. 4(*c*); these three kinds of reinforced manners may be used alone, or may be used in any combination.

Figure 3:
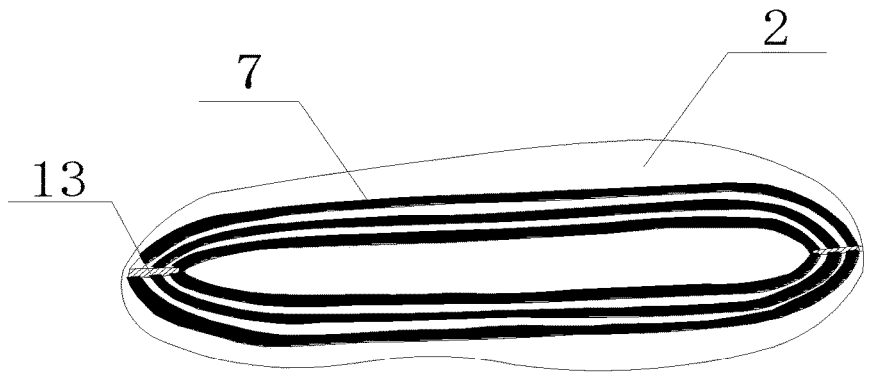
FIG. 3 shows a schematic diagram of the shoe cover sole of one embodiment.

In this embodiment, the shoe cover further comprises a plurality of anti-slip strips 7 provided at the bottom of the shoe cover sole 2 (as shown in FIG. 3), the plurality of anti-slip strips 7 are distributed from the middle to the external of the shoe cover sole 2, each anti-slip strip 7 is in the shape of strip, and is made of non-stick high-friction polymeric material (specifically referring to Chinese invention patent No. 201510305749.1), having a good anti-slip property. Of course, the anti-slip strips 7 may be provided in the shape of strips, circles, dots, S-shapes or other shapes according to requirements, and are made of non-stick high-friction polymeric material.

In another embodiment, as shown in FIGS. 18 to 27, the shoe cover comprising: a shoe cover upper 2101 comprised of non-woven fabric 21, the shoe cover upper 2101 having a front end and a rear end; a shoe cover opening 2103 formed in the shoe cover upper 2101, the shoe cover opening 2103 defined by a top edge of the shoe cover upper 2101; a shoe cover sole 2102 integrated with the shoe cover upper 2101, the shoe cover sole 2102 having a bottom surface; a first sealing part 26 extending from the top edge to the bottom surface of the shoe cover sole 2102 towards the front end of the shoe cover upper 2101; a second sealing part 27 extending from the top edge to the bottom surface of the shoe cover sole 2101 towards a rear end of the shoe cover upper 2101; an elastic ring 22 provided within a first accommodating space of the shoe cover upper proximate the shoe cover opening 2103, below the top edge of the shoe cover upper 2101, wherein a portion of the non-woven fabric 21 is infolded at the top edge of the shoe cover upper 2101 to form the first accommodating space which is a first channel that extends around the shoe cover upper 2101 proximate the shoe cover opening 2103; an elastic strip 23 provided on the shoe cover sole 2102 and extending along a front—rear direction; and a plurality of anti-slip strips 24 disposed on the outer bottom surface of the shoe cover sole 2102, the plurality of anti-slip strips 24 comprised of the isotactic polypropylene polymer and/or an isotactic polypropylene derivative. The non-woven fabric 21 can be replaced with a plastic film or a composite fabric in another embodiment. As shown in FIGS. 23-26, the elastic strip 23 extends from the first sealing part 26 to the second sealing part 27 along the front—rear direction. The anti-slip strips 24 extend along the front—rear direction, and the front and rear end portions of the anti-slip strips 24 in the left side are connected with the front and rear end portions of the anti-slip strips 24 in the right side, respectively, to form several circle area enclosed by the anti-flip strips. The elastic strip 24 is located between the anti-slip strips 24 and in the inner circle enclosure by the anti-skid strips 24.

Figure 19:
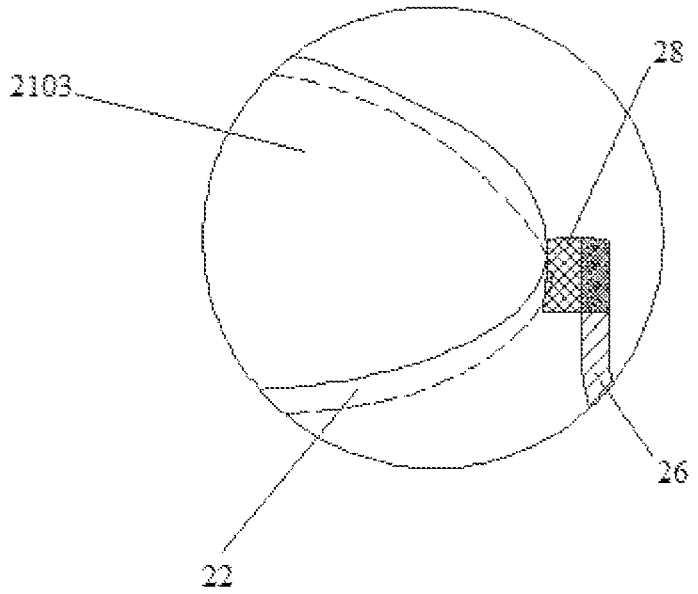
FIG. 19 shows an enlarged view of the position A in FIG. 18, respectively.
Figure 20:
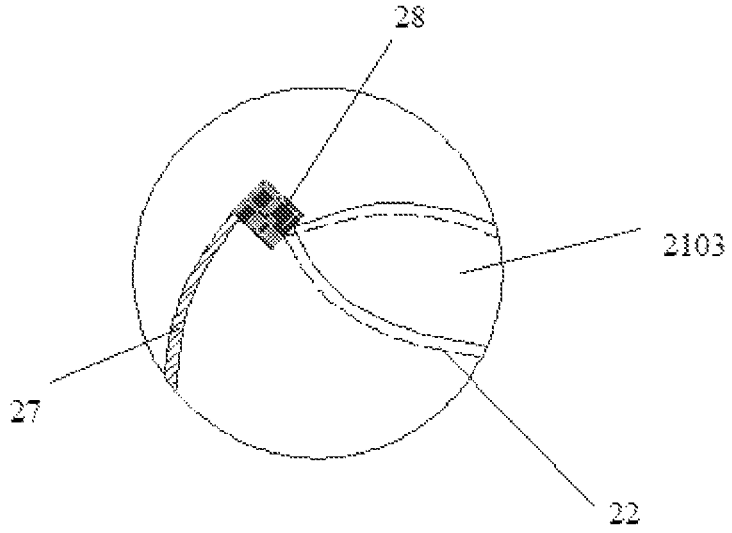
FIG. 20 shows an enlarged view of the position B in FIG. 18, respectively.

As shown in FIG. 19, the first sealing part 26 has a reinforced structure 28 including a blocky fabric folded in half and sealed therewith, wherein the reinforced structure 28 is discretely located at a single location along the first sealing part 26, proximate the top edge of the shoe cover upper 2101. As shown in FIG. 20, the second sealing part 27 has a reinforced structure 28 including a blocky fabric folded in half and sealed therewith, wherein the reinforced structure 28 is discretely located at a single location along the second sealing part 27, proximate the top edge of the shoe cover upper 2101. The two reinforced structures 28 have different colors, shapes or sizes. In this embodiment, the colors of the reinforced structures 28 are different, one is light blue, the other is dark blue, thereby user can easily distinguish front and rear sides of the shoe cover when wearing it.

Figure 21:
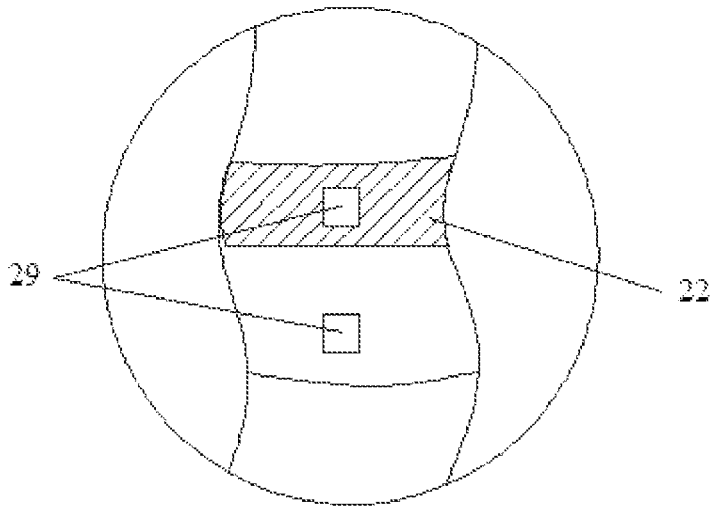
FIG. 21 shows an enlarged view of the position C in FIG. 18, respectively.
Figure 22:
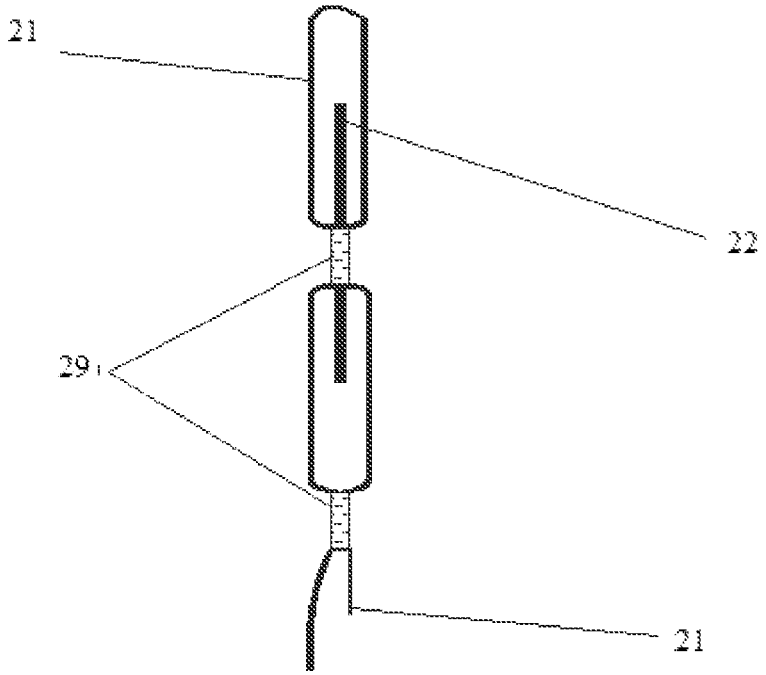
FIG. 22 shows a section view of the position C in FIG. 18.
Figure 23:
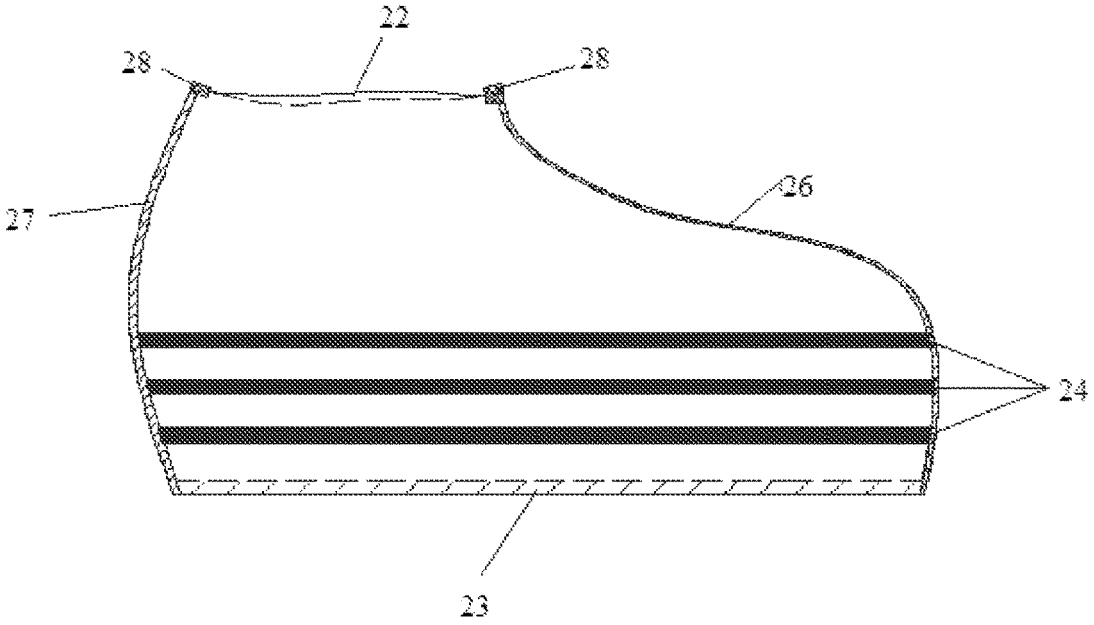
FIG. 23 shows a schematic diagram of the shoe cover in a folded and tightened state of another embodiment.
Figure 24:
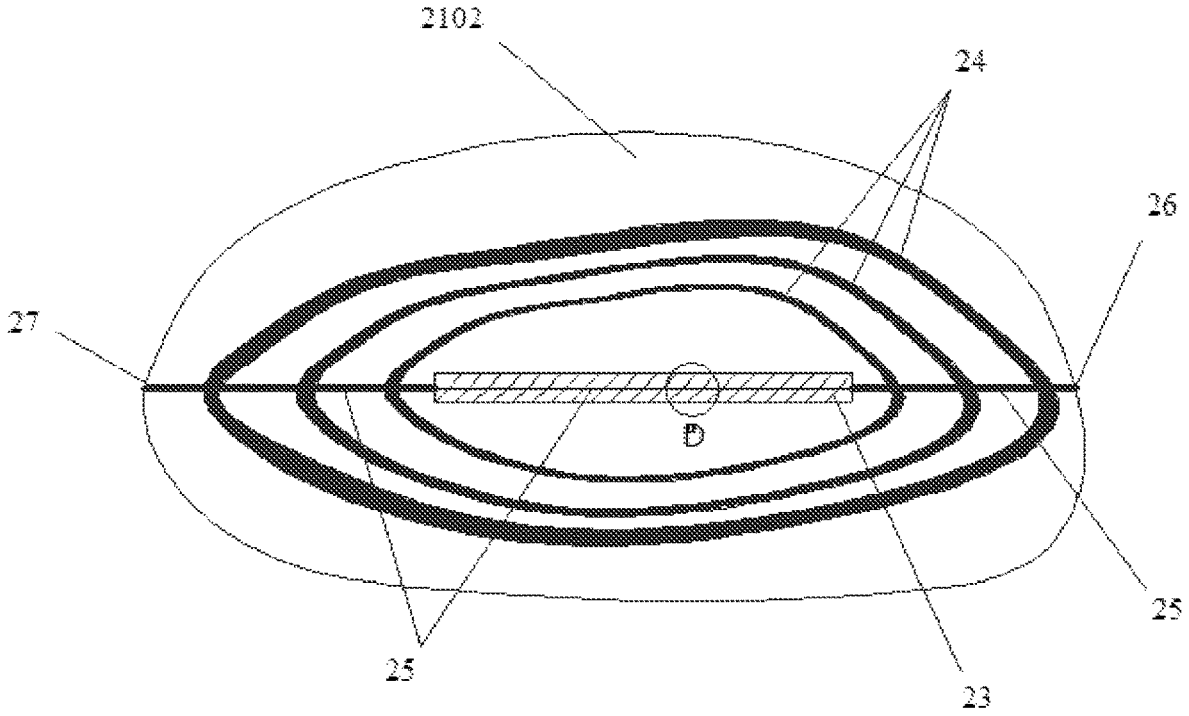
FIG. 24 shows a schematic diagram of the shoe cover sole of another embodiment.

The elastic ring 22 and the elastic strip 23 are connected to the non-woven fabric 21 by ultrasonic welding, sewing, glue bonding, heat sealing or high frequency sealing; and/or, the elastic strip is covered by a fabric strip 210 or not. As shown in FIGS. 21 and 22, the elastic ring 22 is connected to the non-woven fabric 21 via several ultrasonic welding spots 29. As shown in FIGS. 25 and 26, the elastic strip 23 is connected to an inner surface of the shoe cover sole 2102 by using ultrasonic welding. In particular, the elastic strip 23 is connected between the inner surface of the shoe cover sole 2102 and a fabric strip 210, the three are connected via three rows of ultrasonic welding spots 29.

In yet another embodiment, as shown in FIG. 27, the elastic strip 23 is connected to an outer surface of the shoe cover sole 2102 by using ultrasonic welding. In particular, the elastic strip 23 is connected between the outer surface of the shoe cover sole 2102 and a fabric strip 210, the three are connected via three rows of ultrasonic welding spots 29.

The non-stick high-friction polymeric material may employ a known type. The present application discloses a new kind of non-stick high-friction polymeric material to achieve better effects. The non-stick high-friction polymeric material contains an isotactic polypropylene polymer and/or an isotactic polypropylene derivative, and the flow rate parameter of the isotactic polypropylene polymer and/or the isotactic polypropylene derivative is 5-15, preferably 5.5-8; the flow rate parameter is calculated as $(MI_{5\ KG}-MI_{2.16\ KG})/(5-2.16)$, where $MI_{5\ kg}$ and $MI_{2.16\ kg}$ are melt indexes respectively measured according to ASTM Standard D1238 (Standard Test Method for Melt Flow Rates of Thermoplastics) at 190° C. and at a test loads of 5 kg and 2.16 kg, respectively, namely the ratios of the melt index increment to the load increment for the two loads, representing the sensitivity of the material to shear forces.

Further, the non-stick high-friction polymeric material contains an isotactic polypropylene structure and/or an isotactic polypropylene derivative structure (the polypropylene derivative structure here refers to a polypropylene structure which is grafted or segmented with usual groups such as ethyl, butyl, hexyl, octyl, etc.), which specifically refers to the structure of the general formula of it or components thereof contains a block of an isotactic polypropylene structure and/or an isotactic polypropylene derivative structure, and a block of such chemical structures may be arranged irregularly or regularly; and the flow rate parameter of the isotactic polypropylene structure and/or the isotactic polypropylene derivative structure is 5-15.

Further, the isotactic polypropylene polymer and/or the isotactic polypropylene derivative contain isotactic co-polypropylene elastomer containing 5-30% by mass of ethylene structures and/or isotactic homo-polypropylene having a melt index of 1-15 g/10 min, namely the melt index measured according to ASTM Standard D1238 at 190° C. and at a test load of 2.16 kg is 1-15 g/10 min.

Further, the raw material formula of the non-stick high-friction polymeric material contains the following components in percentage by mass:

20-90% of isotactic co-polypropylene elastomer; 10-80% of isotactic homo-polypropylene. In an embodiment, it may further contain 0-10% of a slip agent; 0-10% of an anti-block agent; 0-10% of an antistatic agent; 0-10% of a color masterbatch; 0-10% of a flame retardant; 0-10% of an antibacterial agent; 0-10% of a filling agent. Specifically, it may be added according to practical requirements, and it should be noted that some unexpected effects may be obtained when a variety of additives (for example, slip agents, antistatic agents, antibacterial agents and flame retardants) are used in combination: improving the toughness and the adhesion property with other substances of the polymeric material. Or, the blending ratio is 10-99.5% of isotactic co-polypropylene elastomer, 0-90% of polyethylene, 0-10%, preferably 0.5-10% of each of a slip agent, an anti-block agent, an antistatic agent, a color masterbatch, a flame retardant, an antibacterial agent, a filling agent.

The polymeric material employed the above proportions, is made to be a film through melt-mixing, and film blowing or film casting; or is made to be a non-woven fabric composite through on-line thermal bonding with polypropylene non-woven fabric, cooling and curing, wherein the polypropylene non-woven fabric may select corona-treated non-woven fabric to improve the adhesion. The film can be a monolayer film, or a coextruded or composite multilayer film of double layers or more, and maybe single-sided or double-sided non-slip.

The on-line bonding method includes on-line film casting, on-line coating and the like; the non-woven fabric composite may be single-sided or double-sided fully bonded, locally partially bonded, partially bonded in strip, dot, circle or other shape. Due to the present application contains the isotactic polypropylene structure and/or the isotactic polypropylene derivative structure, it has excellent mechanical properties; at the same time, the material with a specific flow rate parameter and melt index produces unexpected effects: the material obtained has high slip resistance and no stickness. And, the non-woven composite consists of a polymeric material containing an isotactic polypropylene structure or/and an isotactic polypropylene derivative structure on one side and a polypropylene on the other side, and with the same family of polymeric material, the two surface layers on both sides form a homogeneous single-phase structure through mutually diffusing, mutually penetrating and mutually entangling of molecules after heating and melting, which has a strong bonding strength after curing, without using adhesive. COF (coefficient of friction) thereof can be up to 0.3-1.8.

Further, the raw material formula of the non-stick high-friction polymeric material contains the following components in percentage by mass:

10-99.5% of isotactic co-polypropylene elastomer; 0-90% of polyethylene. In an embodiment, it may further contain 0-10% of a slip agent; 0-10% of an anti-block agent; 0-10% of an antistatic agent; 0-10% of a color masterbatch; 0-10% of a flame retardant; 0-10% of an antibacterial agent; 0-10% of a filling agent.

Further, the melt index of the isotactic polypropylene polymer and/or the isotactic polypropylene derivatives is 0.5-20 g/min; or, the density of the isotactic polypropylene polymer and/or the isotactic polypropylene derivative is 0.7-1.1 g/cm$^3$.

The compositions and properties of the above-mentioned new non-stick high-friction polymeric material are introduced through specific embodiments in the following:

EMBODIMENT 1

Figure 7:
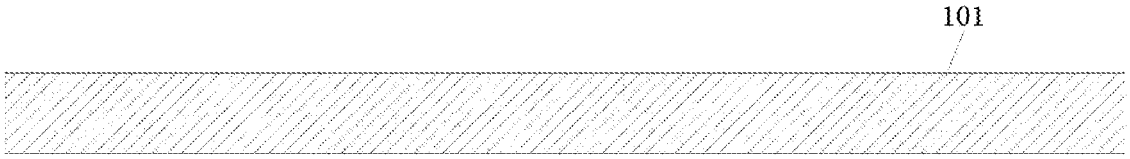
FIG. 7 shows a monolayer film made of the non-stick high-friction polymeric material disclosed by the present application.

Referring to FIG. 7, it is a non-stick high-friction monolayer film material disclosed by the present application, 101 is a film containing isotactic polypropylene polymer and derivative, and the compositions in percentage by mass thereof are: 60% of isotactic co-polypropylene elastomer, 38% of polyethylene, 2% of an antistatic agent; the thickness of the film is 30 um.

The flow rate parameter of the isotactic co-polypropylene elastomer is 6.0. According to ASTM D1894, the COF is measured to be 1.25, and the results of comparison with existing materials in the market and other embodiments are shown in Table 1.

Figure 15:
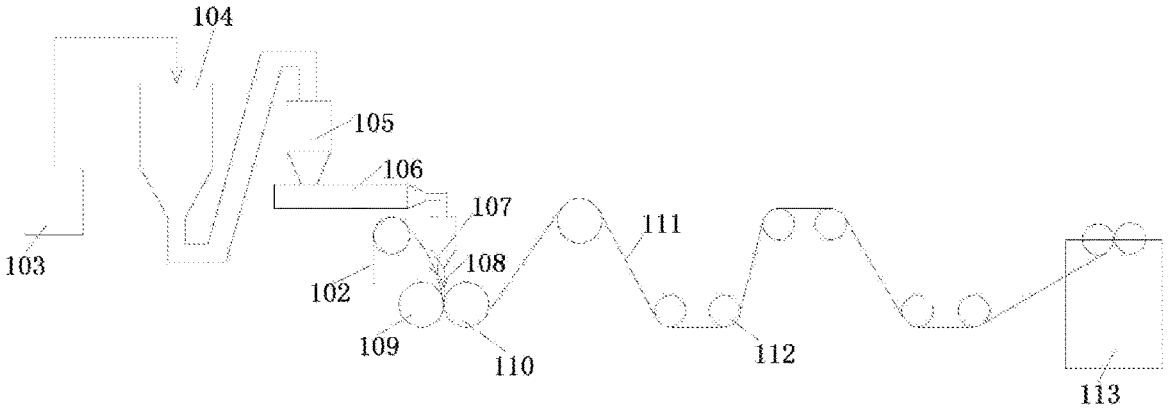
FIG. 15 shows a film casting preparation method of the non-stick high-friction material disclosed by the present application.

The present embodiment employs the film casting and extruding process, referring to FIG. 15, and the operating steps are as follows:

(1) weighing raw materials in the weighing area 103 according to the formulating ratio, (2) sucking the well-weighed raw materials into a high-speed mixer 104, (3) sucking the mixed raw materials into a extruder hopper 105, (4) melt mixing the raw materials in the extruder 106 and extruding the raw materials to be a melt curtain 108 through a die head 107, the temperature of the die head is controlled at 150-250° C., (5) casting the melt curtain between a steel roll 110 and a rubber roll 109, cooling and curing to obtain a film 111 at a pressure of laminating of 2.0-6.0 kgf/cm$^2$, which passes through a flattening roll 112 and a winding device 113 to give the material.

EMBODIMENT 2

Figure 16:
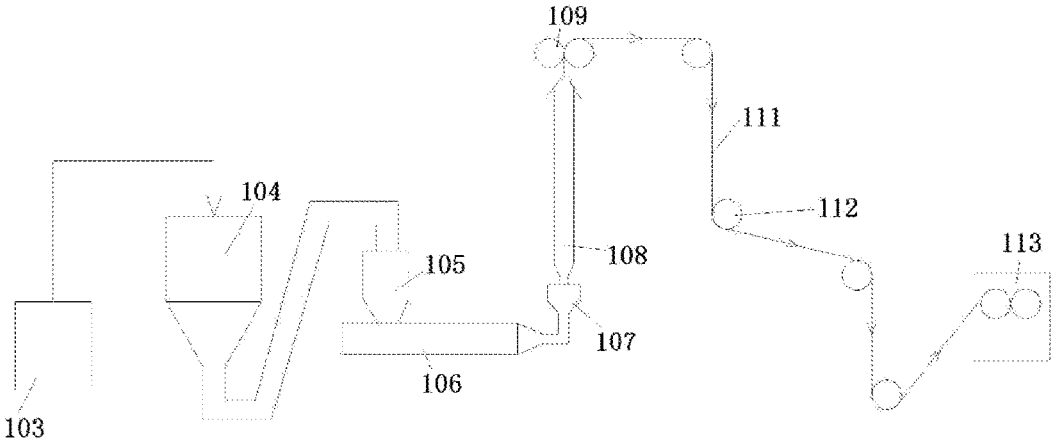
FIG. 16 shows a film blowing preparation method of the non-stick high-friction material disclosed by the present application.

The present embodiment employs the formulating ratio of Embodiment 1, and utilizes the film blowing and extruding process, referring to FIG. 16, and the operating steps are as follows:

(1) weighing raw materials in the weighing area 103 according to the formulating ratio, (2) sucking the well-weighed raw materials into a high-speed mixer 104, (3) sucking the mixed raw materials into a extruder hopper 105, (4) melt mixing the raw materials in the extruder 106 and extruding the raw materials to be a cylindrical thin bubble 108 through an annular die head 107 whose temperature is controlled at 150-250° C., cooling the cylindrical thin bubble through a cooling roll 109 to obtain a cylindrical film 111, flattening the cylindrical film through a drawing and flattening roll 112, winding the cylindrical film through a winding device 113, and single-split, double-split or non-split treating the cylindrical film during winding.

EMBODIMENT 3

Figure 8:
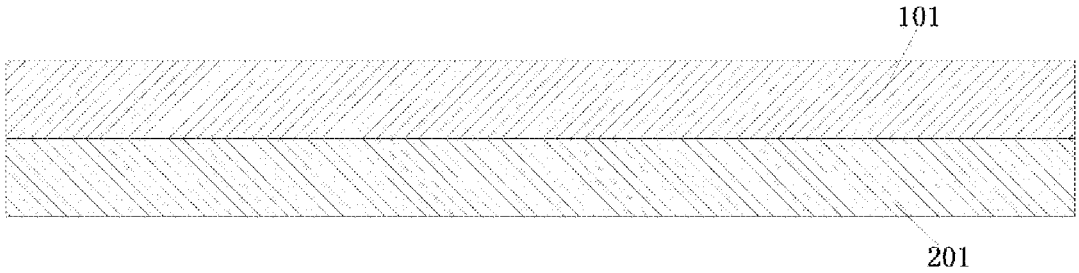
FIG. 8 shows a bi-layer film made of the non-stick high-friction polymeric material disclosed by the present application.

FIG. 8 shows a non-stick high-friction bi-layer film material disclosed by the present application, the thickness of the film is 30 um. 101 is a film containing isotactic polypropylene polymer and derivative, and the compositions in percentage by mass thereof are: 60% of isotactic co-polypropylene elastomer, 38% of polyethylene, 2% of an antistatic agent; the thickness of the film is 30 um. The flow rate parameter of the isotactic co-polypropylene elastomer is 6.0. 201 is polyethylene film. According to ASTM D1894, the COF of the layer surfaces of FIG. 2—101 and FIG. 2—201 are measured to be 1.25 and 0.30, respectively. The results of comparison with existing materials in the market and other embodiments are shown in Table 1.

The present embodiment employs a double-layer film casting machine, and the film casting and extruding process is the same as Embodiment 1.

EMBODIMENT 4

Figure 9:
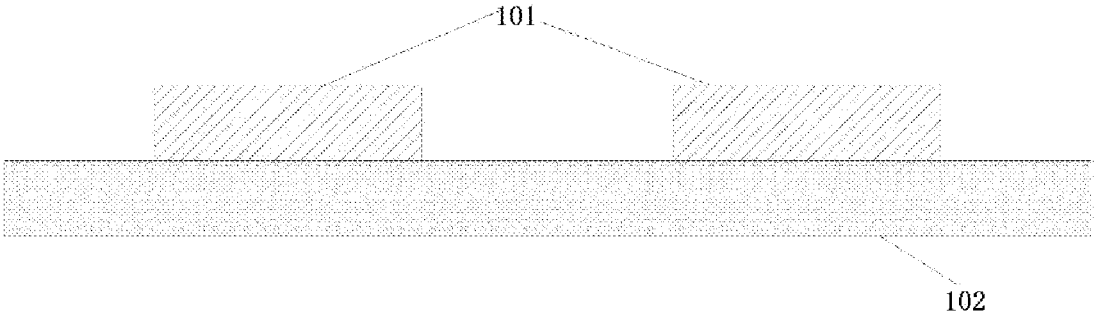
FIG. 9 shows a cross-sectional view of the non-stick high-friction strip-shaped composite disclosed by the present application.
Figure 10:
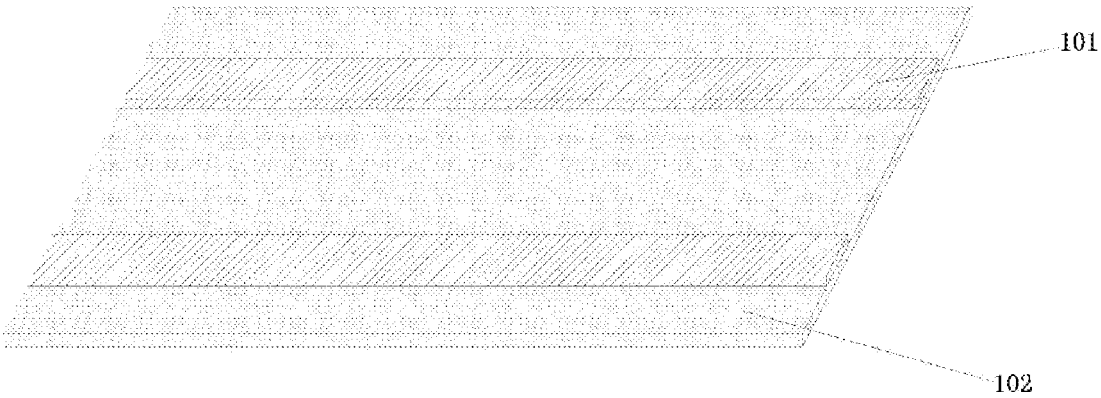
FIG. 10 shows a plan view of the non-stick high-friction strip-shaped composite disclosed by the present application.

FIGS. 9 and 10 show a non-stick high-friction strip-shaped composite disclosed by the present application, the components thereof are two strips of non-stick high-friction strip-shaped isotactic polypropylene polymer layered material (FIGS. 9—101 and 10—101) and polypropylene non-woven fabric (FIGS. 9—102 and 10—102), the compositions of both FIGS. 9—101 and 10—101 in percentage by mass are 80% of isotactic co-polypropylene elastomer, and 20% of isotactic homo-polypropylene; in the present embodiment, the flow rate parameter of the isotactic co-polypropylene elastomer is measured to be 6.0, and the flow rate parameter of the isotactic homo-polypropylene is 7.1, according to ASTM D1238, at 190° C. and at 2.16 kg and 5 kg. The thickness of each strip of non-stick high-friction strip-shaped material is 70 um, the width thereof is 1.0 cm, and the interval there between is 1.0 cm. FIGS. 9—102 and 10—102 are 40 gsm polypropylene non-woven fabrics. According to ASTM D1894, the COF is measured to be 1.36, and the results of comparison with existing products in the market and other embodiments are shown in Table 1.

The present embodiment employs the on-line thermal bonding process, referring to FIG. 15, and the operating steps are as follows:

(1) weighing raw materials in the weighing area 103 according to the formulating ratio, (2) sucking the well-weighed raw materials into a high-speed mixer 104, (3) sucking the mixed raw materials into a extruder hopper 105, (4) melt mixing the raw materials in the extruder 106 and extruding the raw materials to be a melt curtain 108 through a die head 107 (non-stick high-friction strip-shaped material 101), the temperature of the die head is controlled at 150-250° C., (5) casting the melt curtain onto a steel roll 109, drawing the polypropylene non-woven fabric 102 between a steel roll 110 and a rubber roll 109, thermally bonding the melt curtain and the non-woven fabric together at a pressure of laminating of 2.0-6.0 kgf/cm$^2$, cooling and curing to obtain a composite 111, which passes through a flattening roll 112 and a winding device 113 to give the material.

EMBODIMENT 5

Figure 11:
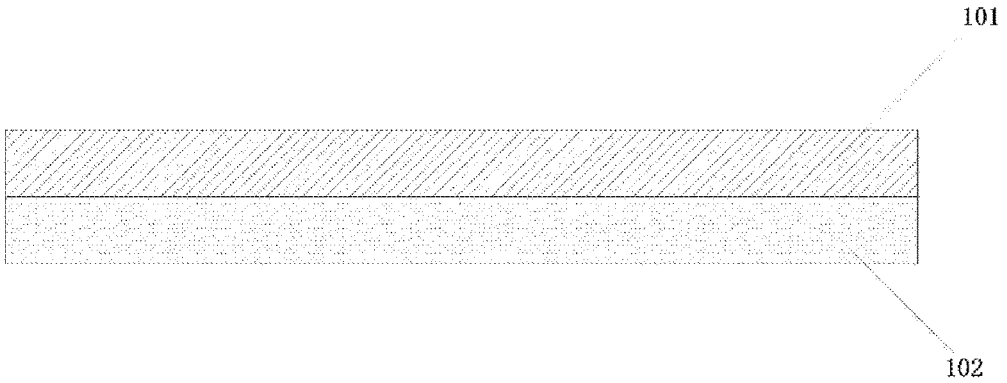
FIG. 11 shows a cross-sectional view of the non-stick high-friction full-composite disclosed by the present application.
Figure 12:
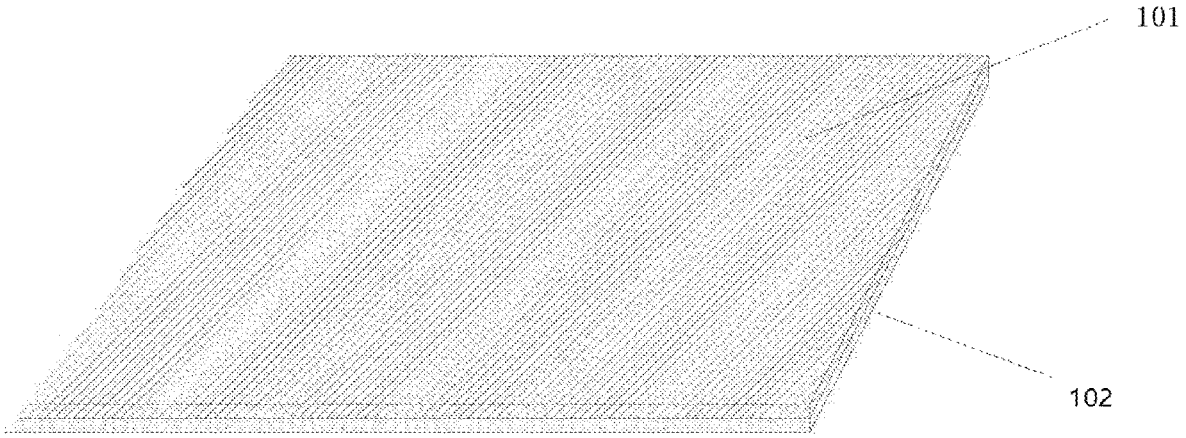
FIG. 12 shows a plan view of the non-stick high-friction full-composite disclosed by the present application.

FIGS. 11 and 12 show a non-stick high-friction full-composite disclosed by the present application, which is a composite structure constituted of a layer of non-stick high-friction isotactic polypropylene polymeric material (FIGS. 11—101 and 12—101) and polypropylene non-woven fabric (FIGS. 11—102 and 12—102), the compositions of both FIGS. 11—101 and 12—101 in percentage by mass are 99.5% of isotactic co-polypropylene elastomer, and 0.5% of an antistatic agent. According to ASTM D1238, at 190° C. and at 2.16 kg and 5 kg, the flow rate parameter of the propylene elastomer in the present embodiment is measured to be 6.0.

The layer thickness of the non-stick high-friction material is 30 um. FIGS. 11—102 and 12—102 are 40 gsm polypropylene non-woven fabrics. According to ASTM D1894, the COF is measured to be 1.52, and the results of comparison with existing products in the market and other embodiments are shown in Table 1.

The on-line thermal bonding process of the present embodiment is the same as Embodiment 4.

EMBODIMENT 6

Figure 13:
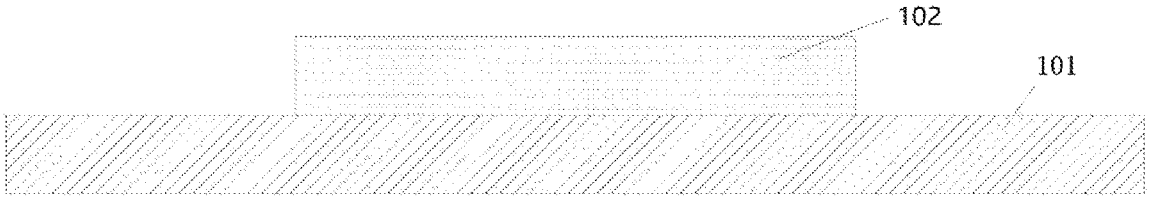
FIG. 13 shows a cross-sectional view of the non-stick high-friction local-composite disclosed by the present application.
Figure 14:
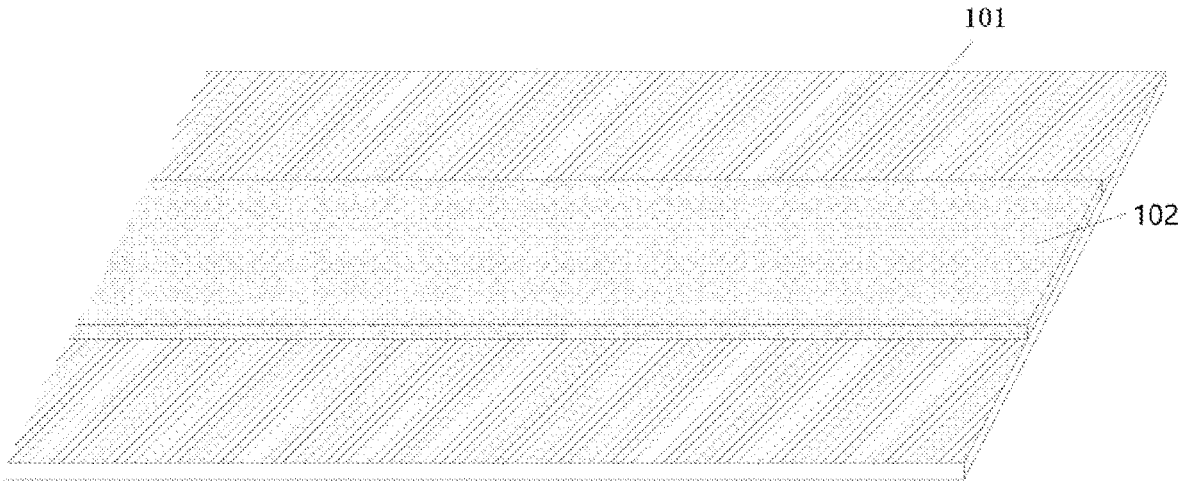
FIG. 14 shows a plan view of the non-stick high-friction local-composite disclosed by the present application.

FIGS. 13 and 14 are a non-stick high-friction local-composite disclosed by the present application, the components thereof are a layer of the polypropylene non-woven fabric (FIGS. 13—102 and 14—102) with a layer of the non-stick high-friction isotactic polypropylene polymeric material (FIGS. 13—101 and 14—101) on one surface thereof, the compositions of 101 in percentage by mass are 80% of isotactic co-polypropylene elastomer, and 20% of polyethylene, the flow rate parameter of the propylene elastomer in the present embodiment is measured to be 6.0, according to ASTM D1238, at 190° C. and at 2.16 kg and 5 kg. The thickness of the non-stick high-friction material layer is 40 um, and the width thereof is 140 cm. FIGS. 13—102 and 14—102 are 40 gsm polypropylene non-woven fabrics, the width thereof is 140 cm, and it is located in the middle of the non-stick high-friction material layer. According to ASTM D1894, the COF is measured to be 1.10, and the results of comparison with existing products in the market and other embodiments are shown in Table 1.

The on-line thermal bonding process of the present embodiment is the same as Embodiment 4.

EMBODIMENT 7

Figure 17:
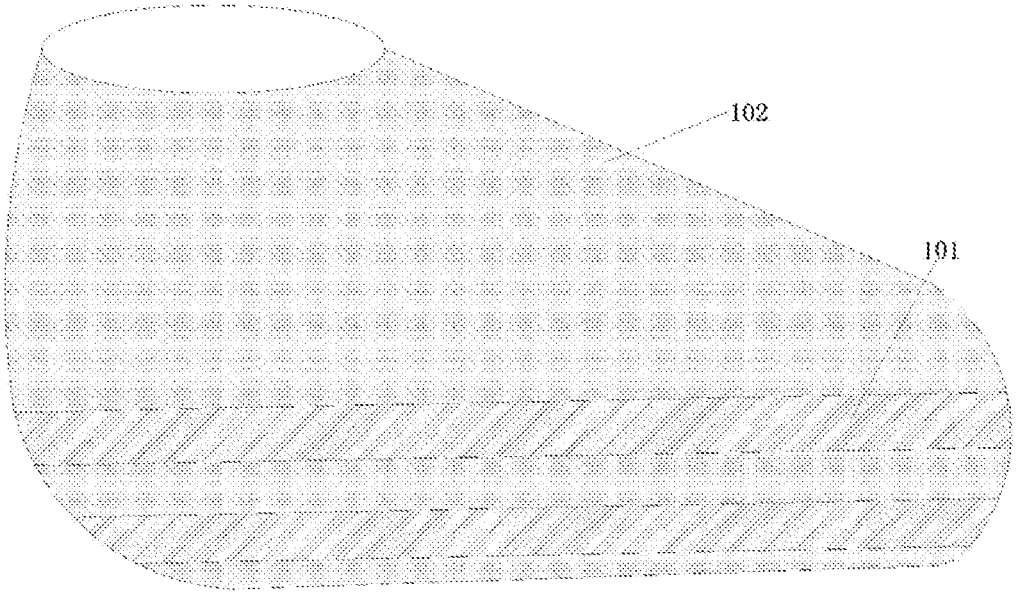
FIG. 17 shows a medical shoe cover disclosed by the present application.

Referring to FIG. 17, the shoe cover employs the material made in Embodiment 4, and is made through typesetting and cutting, and sewing manually or automatically. The shoe cover shown in FIG. 14 is in a situation that it is folded in half at the bottom. The anti-slip portions thereof are isotactic polypropylene polymer strips, the thickness of the anti-slip strips is 70 um, the number thereof is 4, the width thereof is 1.0 cm, the interval between two anti-slip strips is 1.0 cm, and the main body is 40 gsm polypropylene non-woven fabric. According to ASTM D1894, the COF is measured to be 1.36. Through test, this shoe cover has good wearresisting property, and the results of comparison with existing materials in the market and other embodiments are shown in Table 2.

The static friction coefficients and the dynamic friction coefficients of the material made in the above-mentioned Embodiments 1-5 are tested according to ASTM Standard D1894, and the test result is shown in the following Table 1:

| | Property Indexes | |
|---|---|---|
| Comparative Example | Static Friction Coefficient ASTM D1894 | Dynamic Friction Coefficient ASTM D1894 |
| Embodiment 1 (monolayer film) | 1.25 | 0.89 |
| Embodiment 2 (monolayer film) | 1.25 | 0.89 |
| Embodiment 3 (bi-layer film FIG. 2-101 side) | 1.25 | 0.89 |
| Embodiment 4 (strip composite) | 1.36 | 0.93 |
| Embodiment 5 (full composite) | 1.52 | 1.43 |
| Embodiment 6 (local composite) | 1.10 | 0.83 |
| Material 1 in present market (film material) | 0.30 | 0.26 |
| Material 2 in present market (strip composite) | 0.55 | 0.49 |
| Material 2 in present market (full composite) | 0.64 | 0.39 |
| Material 3 in present market (local composite) | 0.30 | 0.26 |

The wear resistance of Embodiment 7 is tested by observing whether the shoe covers lose plastic after the shoe covers are worn on a same person and rubbed on a plastic floor in circles, and the test result is shown in the following Table 2:

| | Worn and Peeling off Numbers of cycles | | | |
|---|---|---|---|---|
| Comparative Example | 1 | 5 | 10 | 20 |
| Embodiment 7 (shoe cover-material of Embodiment 4) | No | No | No | No |
| Shoe cover product in present market (shoe cover-material 2 in present market) | No | Worn and Peeling off | Worn and Peeling off | Worn and Peeling off |

The high temperature resistant type of the shoe cover products of Embodiment 7 and in the present market are tested according to ASTM F1980-07, at 80° C. and at 50% RH. The specific operating method is: taking two films of the same material of 10 cm*10 cm, placing the two films face-to-face, putting them in an oven with set temperature and humidity, and checking if the films stick together every hour. The test result is shown in the following Table 3:

| | Stickness Time/hours | | |
|---|---|---|---|
| Comparative Example | 1 | 4 | 8 |
| Embodiment 7 (shoe cover-material of Embodiment 4) | non-stick | non-stick | non-stick |
| Shoe cover product in present market (shoe cover-material 2 in present market) | Slightly stick together | Stick together | Stick together |

From Table 1, it can be seen that the non-stick high-friction material made in the present application has the following advantages when compared with the similar products: it has good anti-slip property, static friction coefficient higher than products in the current market more than 110%, and dynamic friction coefficient higher than 130%.

From Table 2, it can be seen that the non-stick high-friction material and the medical shoe cover products made in the present application has the following advantages when compared with the similar products: they have good wear resistance, do not lose plastic, and have wear resistance at least 4 times of similar products in the market.

From Table 3, it can be seen that the non-stick high-friction material made in the present application has the following advantages when compared with the similar products: it has no stickiness, is not sticky under high temperature, can endure higher temperature transport for a long time, and the high temperature resistant time is at least 8 times of similar products in the market. Applying the material to the shoe covers, may improve the heat resistance of the shoe covers, so as to be convenient for long-time transport.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. A shoe cover comprising:

a shoe cover upper comprised of non-woven fabric, the shoe cover upper having a front end and a rear end;

a shoe cover opening formed in the shoe cover upper, the shoe cover opening defined by a top edge of the shoe cover upper;

a shoe cover sole integrated with the shoe cover upper, the shoe cover sole having a bottom surface;

a first sealing part extending from the top edge to the bottom surface of the shoe cover sole towards the front end of the shoe cover upper, the first sealing part having a first reinforced structure including a blocky fabric folded in half and sealed therewith, wherein the first reinforced structure is discretely located at a single location along the first sealing part, proximate the top edge of the shoe cover upper;

a second sealing part extending from the top edge to the bottom surface of the shoe cover sole towards a rear end of the shoe cover upper;

an elastic ring provided within a first accommodating space of the shoe cover upper proximate the shoe cover opening, below the top edge of the shoe cover upper;

an elastic strip provided on the shoe cover sole and extending along a front—rear direction; and a plurality of anti-slip strips disposed on the outer bottom surface of the shoe cover sole, the plurality of anti-slip strips comprised of an isotactic polypropylene polymer and/or an isotactic polypropylene derivative;

wherein a portion of the front sealing part and a portion of the rear sealing part extends between the plurality of anti-slip strips disposed on the outer bottom surface of the shoe cover sole;

wherein the second sealing part has a second reinforced structure including a blocky fabric folded in half and sealed therewith, wherein the second reinforced structure is discretely located at a single location along the second sealing part, proximate the top edge of the shoe cover upper;

wherein the first and second reinforced structures have different colors, shapes or sizes.

2. The shoe cover according to claim 1, wherein the elastic strip extends from the first sealing part to the second sealing part.

3. The shoe cover according to claim 1, wherein the elastic strip is located in an inner circle enclosure by the anti-skid strips.

4. The shoe cover according to claim 1, wherein the elastic strip is connected to an inner surface of the shoe cover sole.

5. The shoe cover according to claim 4, wherein the elastic strip is connected between the inner surface of the shoe cover sole and a fabric strip.

6. The shoe cover according to claim 1, wherein the elastic strip is connected to an outer surface of the shoe cover sole.

7. The shoe cover according to claim 6, wherein the elastic strip is connected between the outer surface of the shoe cover sole and a fabric strip.

8. The shoe cover according to claim 1, wherein a flow rate parameter of the isotactic polypropylene polymer and/or the isotactic polypropylene derivative is 5.5-8.

9. The shoe cover according to claim 1, wherein a raw material formula of the isotactic polypropylene polymer and/or the isotactic polypropylene derivative contains the following components in percentage by mass:

isotactic co-polypropylene elastomer 20-90%;

isotactic homo-polypropylene 10-80%.

10. The shoe cover according to claim 1, wherein a raw material formula of the isotactic polypropylene polymer and/or the isotactic polypropylene derivative contains the following components in percentage by mass:

isotactic co-polypropylene elastomer 10-99.5%;

polyethylene 0-90%.

11. The shoe cover according to claim 1, wherein the isotactic polypropylene polymer and/or the isotactic polypropylene derivative contains an isotactic co-polypropylene elastomer containing 5-30% by mass of an ethylene structure, and/or an isotactic homo- polypropylene having a melt index of 1-15 g/10 min under conditions of ASTM D1238, 190° C. and 2.16 KG.

12. The shoe cover according to claim 1, wherein the shoe cover is formed by sealing after folding the non-woven fabric in half.

13. The shoe cover according to claim 1, wherein the elastic strip is connected to the shoe cover sole by ultrasonic welding, sewing, glue bonding, heat sealing or high frequency sealing; and/or, the elastic strip is covered by a fabric strip or not.

14. The shoe cover according to claim 1, wherein the front end and the rear end of the shoe cover upper is curve-shaped.

15. The shoe cover according to claim 1, wherein a portion of the non-woven fabric is infolded at the top edge of the shoe cover upper to form the first accommodating space which is a first channel that extends around the shoe cover upper proximate the shoe cover opening.

16. The shoe cover according to claim 1, wherein the anti-slip strips are in a shape of a strip, and extend along the front—rear direction, and the elastic strip is located between the anti-slip strips.

* * * * *